US008644742B2

(12) United States Patent
Onoda

(10) Patent No.: US 8,644,742 B2
(45) Date of Patent: Feb. 4, 2014

(54) DEVELOPER SUPPLY DEVICE AND IMAGE FORMING APPARATUS HAVING THE SAME

(75) Inventor: Suzue Onoda, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 378 days.

(21) Appl. No.: 13/071,033

(22) Filed: Mar. 24, 2011

(65) Prior Publication Data

US 2011/0311278 A1 Dec. 22, 2011

(30) Foreign Application Priority Data

Jun. 17, 2010 (JP) ..... 2010-137851

(51) Int. Cl.
*G03G 15/08* (2006.01)

(52) U.S. Cl.
USPC ..... 399/289; 399/293

(58) Field of Classification Search
USPC ..... 399/55, 266, 289, 292, 293, 281; 430/123.2
See application file for complete search history.

(56) References Cited

U.S. PATENT DOCUMENTS 5,027,157 A * 6/1991 Hotomi et al. ..... 399/253
7,792,471 B2 * 9/2010 Aratachi ..... 399/265
8,081,909 B2 * 12/2011 Nishiwaki et al. ..... 399/261
8,095,052 B2 * 1/2012 Nishiwaki et al. ..... 399/281
8,112,019 B2 * 2/2012 Onoda et al. ..... 399/281
8,311,462 B2 * 11/2012 Okamura ..... 399/265
8,326,190 B2 * 12/2012 Hattori ..... 399/281
8,346,136 B2 * 1/2013 Maeda et al. ..... 399/266
8,412,078 B2 * 4/2013 Nishiwaki ..... 399/254
2009/0080942 A1 3/2009 Nishiwaki et al.
2012/0201576 A1 * 8/2012 Uno et al. ..... 399/281

FOREIGN PATENT DOCUMENTS

JP 2009003307 A * 1/2009
JP 2009-080271 A 4/2009
JP 2009-080299 A 4/2009

* cited by examiner

*Primary Examiner* — Robert Beatty
(74) *Attorney, Agent, or Firm* — Scully, Scott, Murphy & Presser, PC

(57) ABSTRACT

A developer supply device is provided, which includes a developer fluidizing unit including a movable member that moves in a moving direction identical to a developer transfer direction while contacting a predetermined contact range of a developer transfer surface of a transfer board disposed along an inner wall of a developer storage section, which developer fluidizing unit fluidizes development agent stored in the developer storage section by movement of the movable member, and a developer level adjusting unit that adjusts a level of the development agent stored in the developer storage section to be higher than a downstream end of the predetermined contact range of the developer transfer surface of the transfer board in the moving direction of the movable member.

10 Claims, 11 Drawing Sheets

DEVELOPER SUPPLY DEVICE AND IMAGE FORMING APPARATUS HAVING THE SAME

CROSS-REFERENCE TO RELATED APPLICATION

This application claims priority under 35 U.S.C. §119 from Japanese Patent Application No. 2010-137851 filed on Jun. 17, 2010. The entire subject matter of the application is incorporated herein by reference.

BACKGROUND

1. Technical Field

The following description relates to one or more developer supply devices configured to supply charged powdered development agent to an intended device.

2. Related Art

A developer supply device has been known that includes a developer transfer body having a plurality of transfer electrodes. The developer transfer body is disposed on an inner wall surface of a developer case that accommodates development agent, and configured to transfer the development agent under a traveling-wave electric field generated when a multi-phase alternating-current (AC) voltage is applied to the plurality of transfer electrodes.

SUMMARY

In a developer supply device of this kind, in order to supply the development agent to the intended device in a favorable manner, it is required to transfer a stable amount of development agent under the traveling-wave electric field.

Aspects of the present invention are advantageous to provide one or more improved techniques for a developer supply device, which techniques make it possible to transfer a stable amount of development agent under the traveling-wave electric field.

According to aspects of the present invention, a developer supply device is provided, which is configured to supply charged development agent to an intended device. The developer supply device includes a casing including a developer storage section configured to accommodate development agent, a transfer board including a plurality of transfer electrodes, the transfer board being configured to transfer the development agent from the developer storage section to the intended device in a predetermined developer transfer direction under a traveling-wave electric field generated when a transfer bias containing a multi-phase alternating-current voltage component is applied to the transfer electrodes, the transfer board being fixed onto an inner wall of the casing from the developer storage section to a downstream side in the developer transfer direction, a developer fluidizing unit including a movable member configured to move in a moving direction identical to the developer transfer direction while contacting a predetermined contact range of a developer transfer surface of the transfer board disposed along an inner wall of the developer storage section, the developer fluidizing unit being configured to fluidize the development agent stored in the developer storage section by movement of the movable member, and a developer level adjusting unit configured to adjust a level of the development agent stored in the developer storage section to be higher than a downstream end of the predetermined contact range of the developer transfer surface of the transfer board in the moving direction of the movable member.

According to aspects of the present invention, further provided is an image forming apparatus that includes a photoconductive body configured such that a development agent image is formed thereon, and a developer supply device configured to supply charged development agent to the photoconductive body. The developer supply device includes a casing including a developer storage section configured to accommodate the development agent to be supplied, a transfer board including a plurality of transfer electrodes, the transfer board being configured to transfer the development agent from the developer storage section to the photoconductive body in a predetermined developer transfer direction under a traveling-wave electric field generated when a transfer bias containing a multi-phase alternating-current voltage component is applied to the transfer electrodes, the transfer board being fixed onto an inner wall of the casing from the developer storage section to a downstream side in the developer transfer direction, a developer fluidizing unit including a movable member configured to move in a moving direction identical to the developer transfer direction while contacting a predetermined contact range of a developer transfer surface of the transfer board disposed along an inner wall of the developer storage section, the developer fluidizing unit being configured to fluidize the development agent stored in the developer storage section by movement of the movable member, and a developer level adjusting unit configured to adjust a level of the development agent stored in the developer storage section to be higher than a downstream end of the predetermined contact range of the developer transfer surface of the transfer board in the moving direction of the movable member.

BRIEF DESCRIPTION OF THE ACCOMPANYING DRAWINGS

Figure 5:
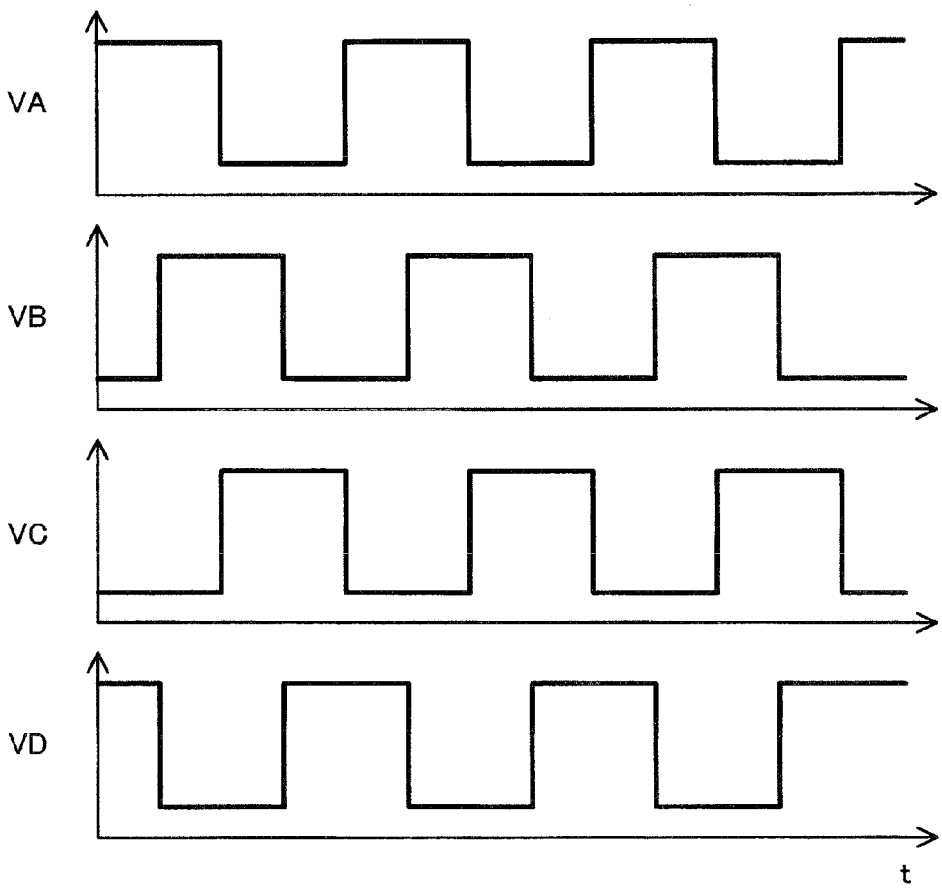

FIG. 5 exemplifies a waveform of an output voltage generated by each power supply circuit for the transfer board in the embodiment according to one or more aspects of the present invention.

Figure 6A:
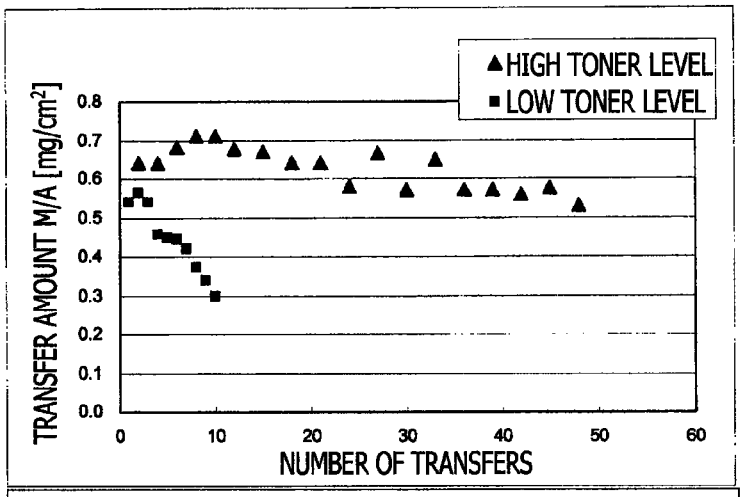
Figure 6B:
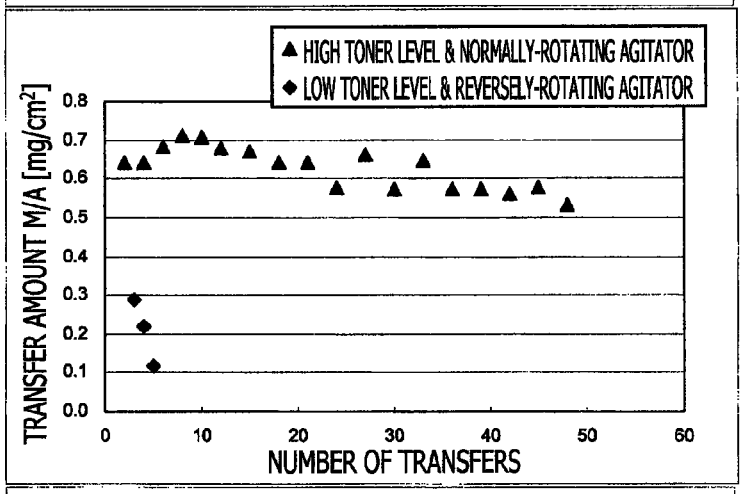
Figure 6C:
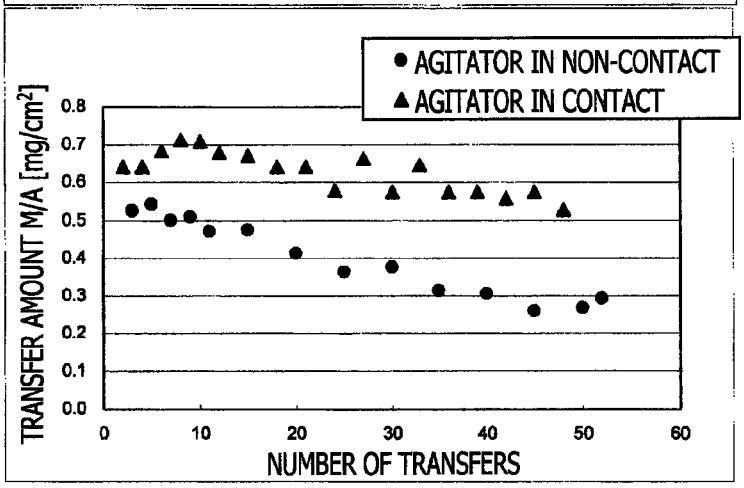

FIGS. 6A to 6C show experimental results of time-dependent changes of the amount of toner transferred by the transfer board under various conditions and effects brought about by the toner supply device in the embodiment according to one or more aspects of the present invention.

Figure 7:
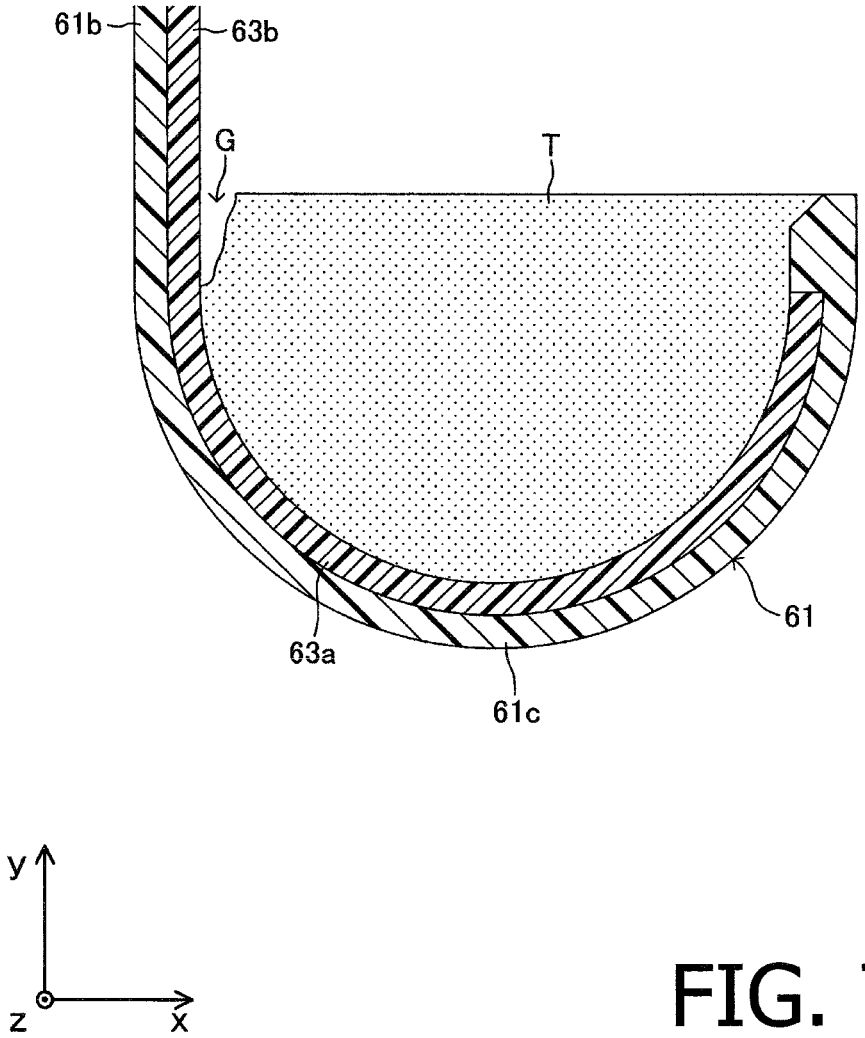

FIG. 7 schematically shows a "cliff" (i.e., a local and drastic cave-in of the level of the toner) formed when the toner is not sufficiently agitated (fluidized) in the toner supply device in the embodiment according to one or more aspects of the present invention.

Figure 8:
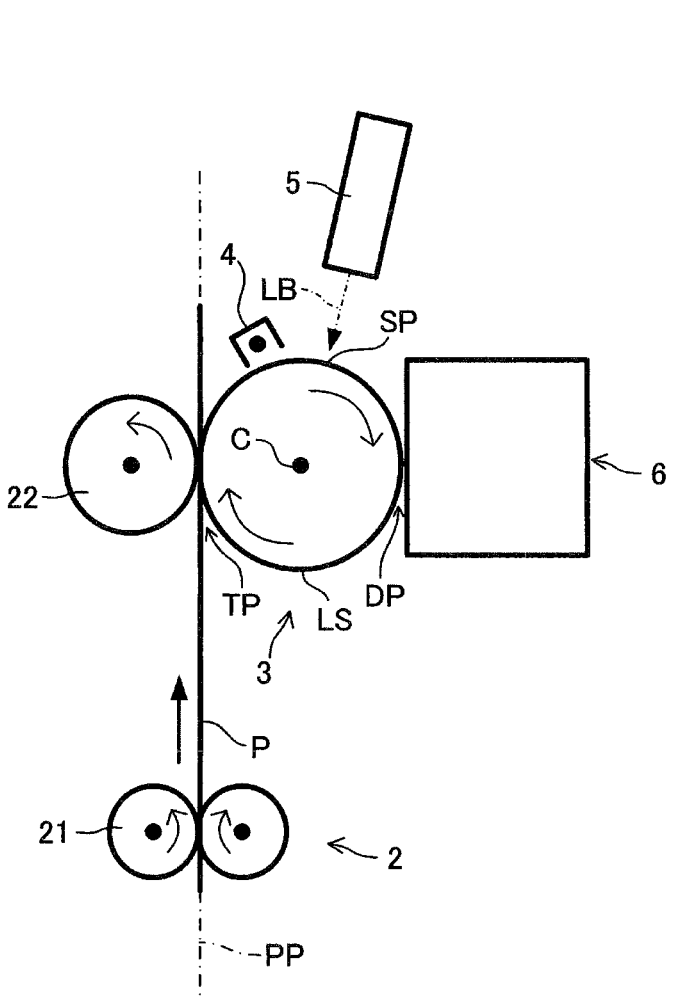
Figure 8:
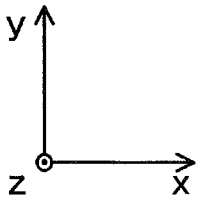

FIG. 8 is a side view schematically showing a configuration of a laser printer including a toner supply device in a modification according to one or more aspects of the present invention.

Figure 9:
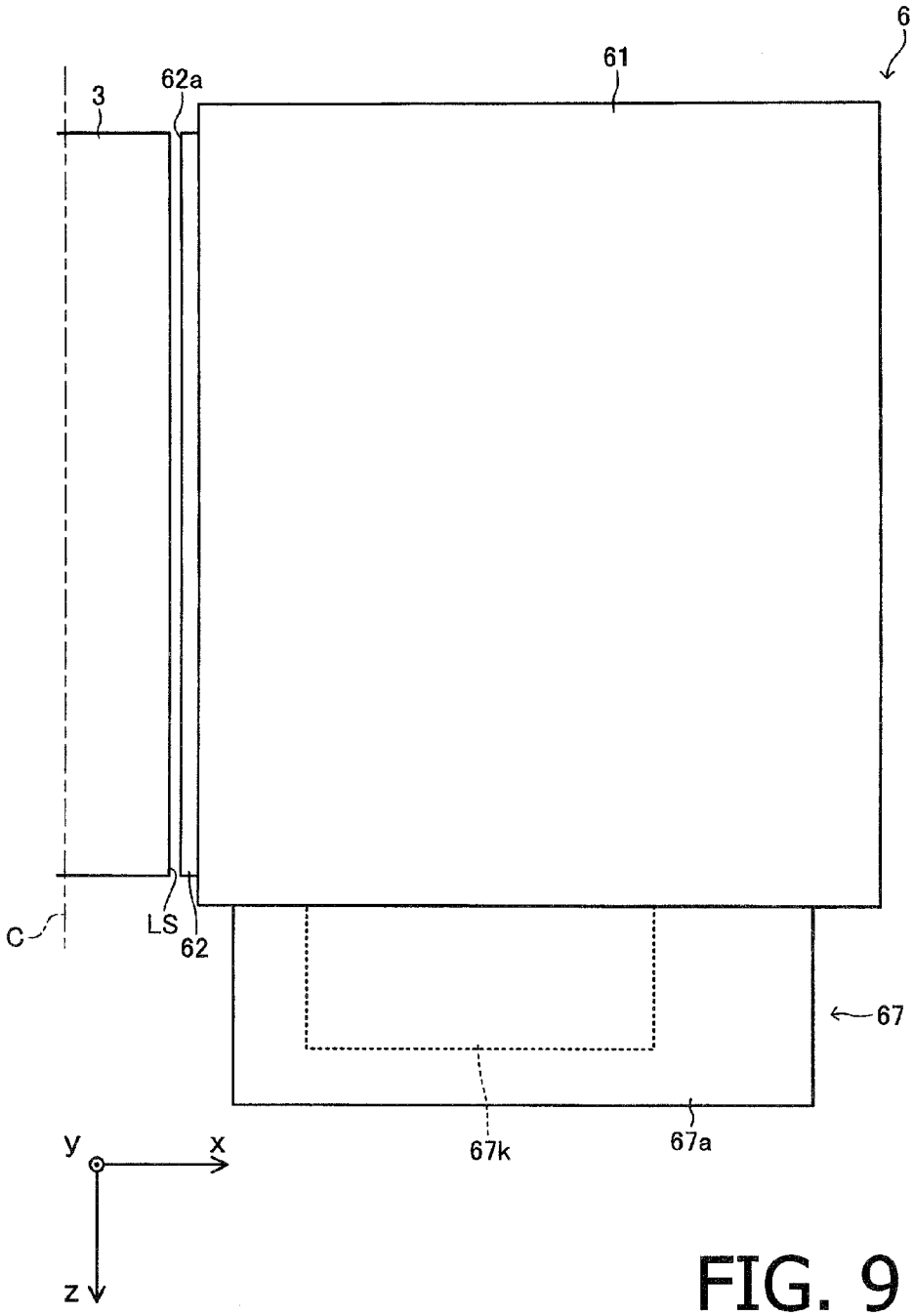

FIG. 9 is a top view schematically showing the toner supply device in the modification according to one or more aspects of the present invention.

Figure 10:
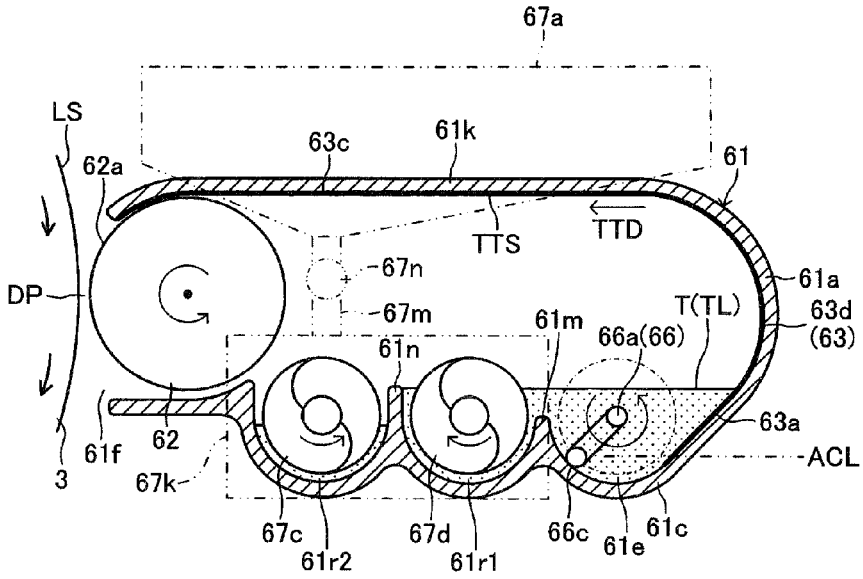
Figure 10:
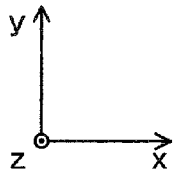

FIG. 10 is a cross-sectional side view schematically showing the toner supply device in the modification according to one or more aspects of the present invention.

Figure 11:
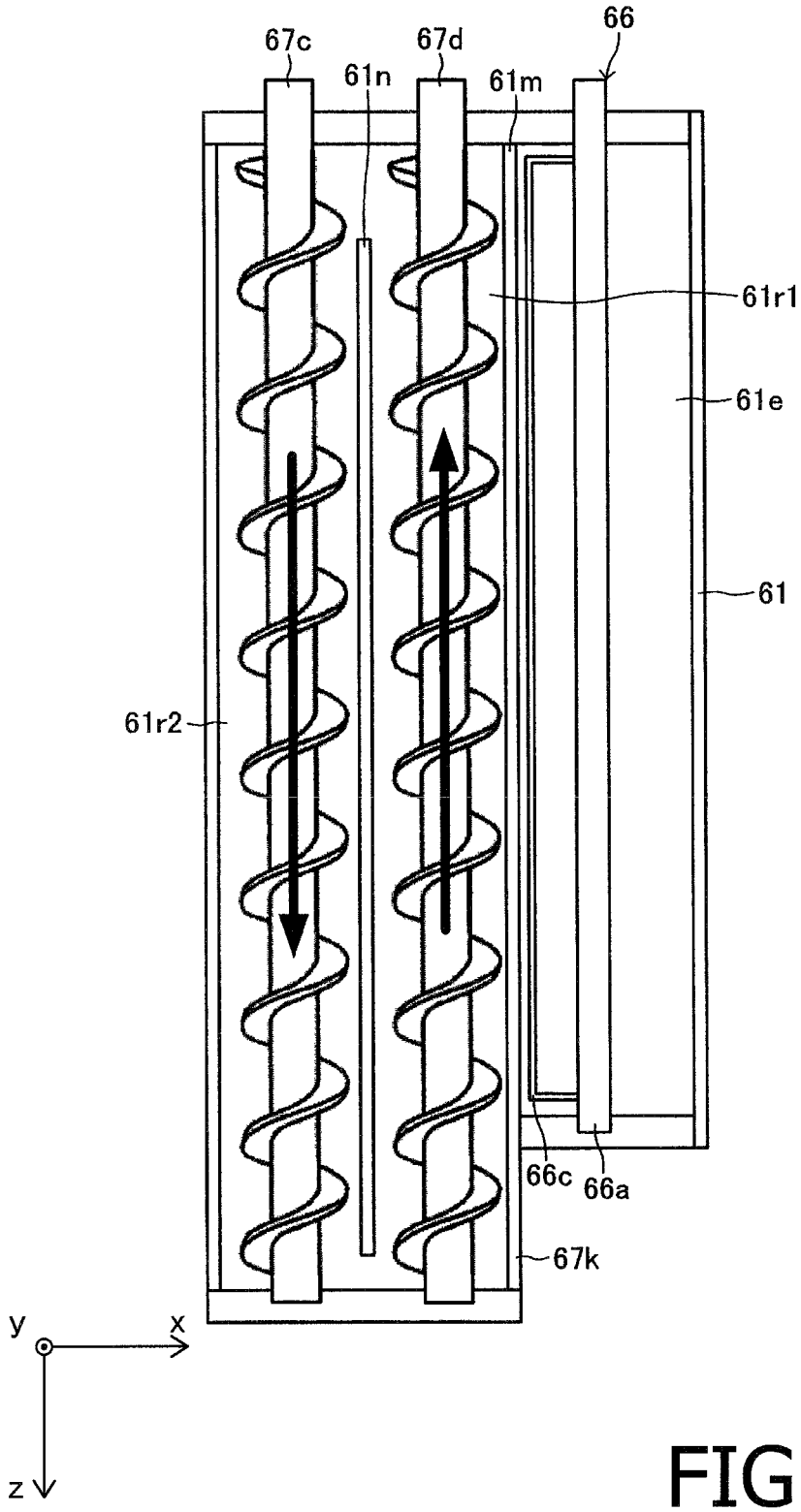

FIG. 11 is a cross-sectional top view schematically showing a portion around a toner storage section of the toner supply device in the modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings.

<Configuration of Laser Printer>

Figure 1:
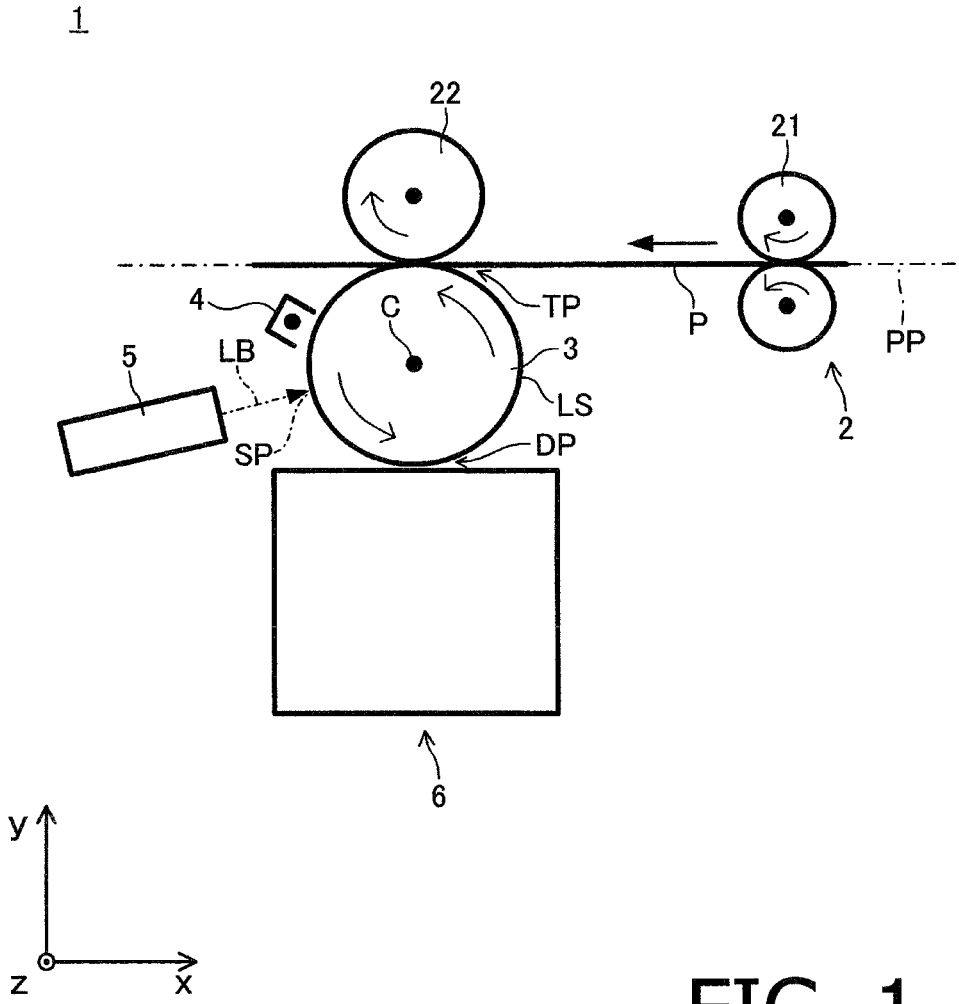
FIG. 1 is a side view schematically showing a configuration of a laser printer in an embodiment according to one or more aspects of the present invention.

As illustrated in FIG. 1, a laser printer 1 includes a sheet feeding mechanism 2, a photoconductive drum 3, an electrification device 4, a scanning unit 5, and a toner supply device 6. A feed tray (not shown), provided in the laser printer 1, is configured such that a stack of sheets P is placed thereon. The sheet feeding mechanism 2 is configured to feed the sheets P placed on the feed tray, on a sheet-by-sheet basis along a predetermined sheet feeding path PP.

On a circumferential surface of the photoconductive drum 3, an electrostatic latent image holding surface LS is formed as a cylindrical surface parallel to a main scanning direction (i.e., a z-axis direction in FIG. 1, hereinafter which may be referred to as a width direction). The electrostatic latent image holding surface LS is configured such that an electrostatic latent image is formed thereon in accordance with an electric potential distribution. Further, the electrostatic latent image holding surface LS is configured to hold toner T (see FIG. 2) in positions corresponding to the electrostatic latent image. The photoconductive drum 3 is driven to rotate in a predetermined direction (counterclockwise in FIG. 1) around a central axis parallel to the main scanning direction. Thus, the photoconductive drum 3 is configured to move the electrostatic latent image holding surface LS along an auxiliary scanning direction perpendicular to the main scanning direction.

The electrification device 4 is disposed to face the electrostatic latent image holding surface LS, so as to evenly and positively charge the electrostatic latent image holding surface LS. The scanning unit 5 is configured to generate a laser beam LB modulated based on image data and to scan the laser beam LB, which is converged in a scanned position SP on the electrostatic latent image holding surface LS, along the main scanning direction. Namely, the scanning unit 5 is configured such that an electrostatic latent image is formed on the electrostatic latent image holding surface LS.

The toner supply device 6 is disposed under the photoconductive body 3, so as to face the photoconductive body 3 in a development position DP which is downstream relative to the scanned position SP in a moving direction of the electrostatic latent image holding surface LS moving in response to rotation of the photoconductive drum 3. The toner supply device 6 is configured to supply the charged toner T (see FIG. 2) to the electrostatic latent image holding surface LS in the development position DR Subsequently, a detailed explanation will be provided about a specific configuration of each element included in the laser printer 1.

The sheet feeding mechanism 2 includes a pair of registration rollers 21 and a transfer roller 22. The registration rollers 21 are configured to feed a sheet P toward a transfer position TP (which is downstream relative to the development position DP in the moving direction of the electrostatic latent image holding surface LS moving in response to rotation of the photoconductive drum 3) between the photoconductive drum 3 and the transfer roller 22 at a predetermined moment. The transfer roller 22 is disposed to face the electrostatic latent image holding surface LS across the sheet feeding path PP (the sheet P) in the transfer position TP. Additionally, the transfer roller 22 is driven to rotate in a direction (clockwise in FIG. 1) opposite to the rotational direction of the photoconductive drum 3. Further, the transfer roller 22 is connected with a transfer bias power supply circuit (not shown), such that a predetermined transfer bias voltage is applied for transferring, onto the sheet P, the toner T (see FIG. 2) adhering onto the electrostatic latent image holding surface LS.

<<Toner Supply Device>>

Figure 2:
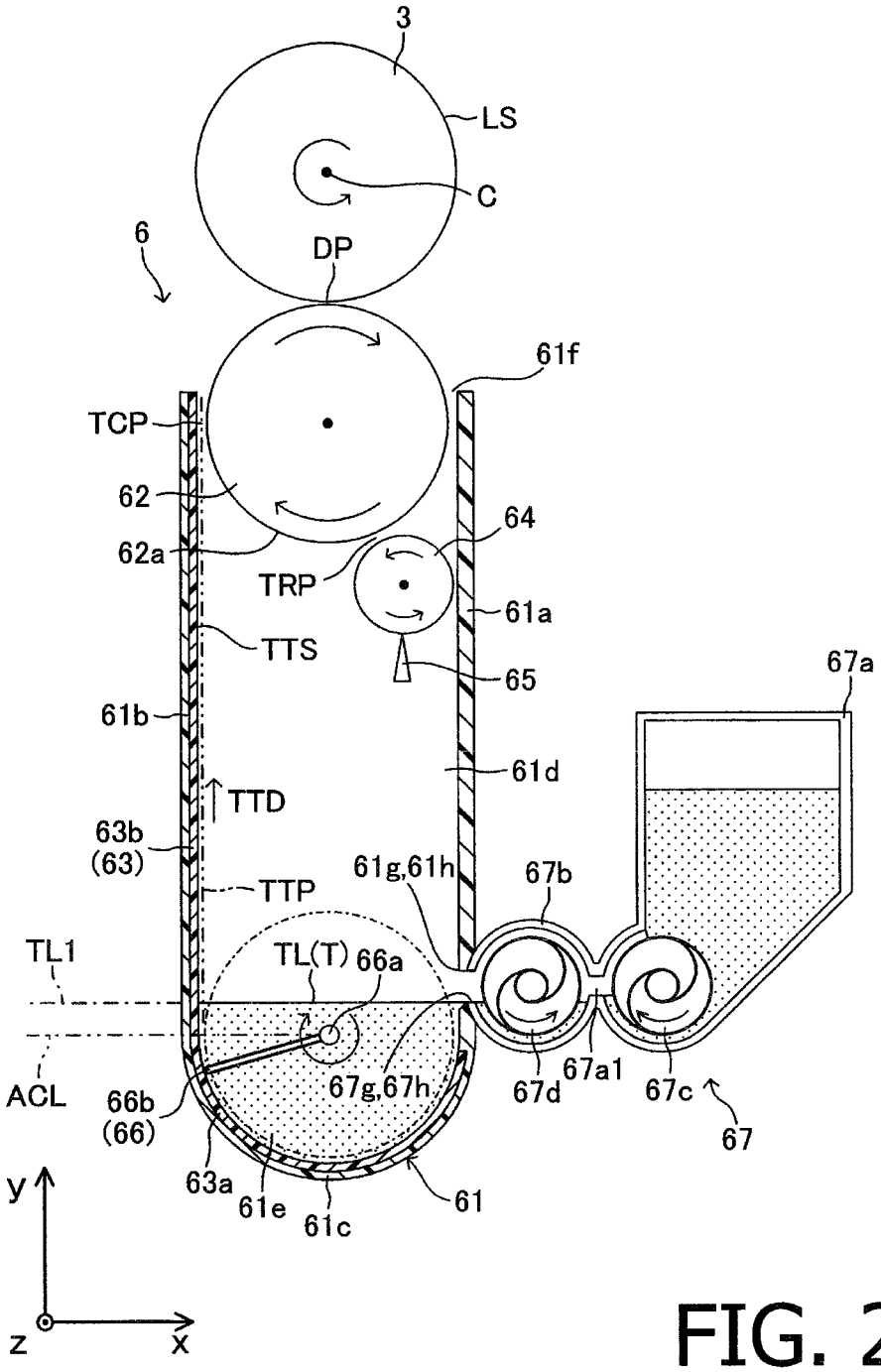
FIG. 2 is an enlarged cross-sectional side view of a toner supply device for the laser printer in the embodiment according to one or more aspects of the present invention.

As depicted in FIG. 2 that is a cross-sectional side view showing the toner supply device 6 in an enlarged manner, a casing 61 of the toner supply device 6 is a box-shaped member that is formed substantially in an upward-open "U" shape when viewed in the z-axis direction. Further, the casing 61 is disposed to have a longitudinal direction parallel to an up-to-down direction (i.e., the y-axis direction in FIG. 2, which may be referred to as a vertical direction). The casing 61 is configured to accommodate the powdered toner T. It is noted that in the embodiment, the toner T is positively-chargeable non-magnetic-one-component black toner.

The casing 61 includes a rear panel 61*a*, a front panel 61*b*, a bottom plate 61*c*, and two side panels 61*d*.

The rear panel 61*a* is a flat plate member disposed parallel to the main scanning direction and the up-to-down direction. The rear panel 61*a* stands to be perpendicular to the horizontal plane. The front panel 61*b* is a flat plate member disposed parallel to the rear panel 61*a*. The front panel 61*b* stands to be perpendicular to the horizontal plane. The rear panel 61*a* and the front panel 61*b* are provided to face each other, such that respective upper ends thereof have the same height and extend parallel to the main scanning direction.

The bottom plate 61*c* is an upward-open half-cylindrical member having a central axis line parallel to the main scanning direction. The bottom plate 61*c* is connected with respective lower ends of the rear panel 61*a* and the front panel 61*b*. In other words, each of the rear panel 61*a* and the front panel 61*b* extends from a corresponding one of upper ends of the bottom plate 61*c* toward the photoconductive drum 3. Further, the two side panels 61*d* are provided to shield both sides of a synthetic resin frame in the z-axis direction, which frame is formed integrally with the rear panel 61*a*, the front panel 61*b*, and the bottom plate 61*c* and substantially formed in a "U" shape when viewed in the z-axis direction.

A toner storage section 61*e* is formed at a bottom of a space surrounded by the rear panel 61*a*, the front panel 61*b*, the bottom plate 61*c*, and the two side panels 61*d*. Further, a development-roller exposure opening 61*f* is formed by upper ends of the rear panel 61*a*, the front panel 61*b*, and the two side panels 61*d*. The development-roller exposure opening 61*f* is open up toward the photoconductive drum 3.

Figure 3:
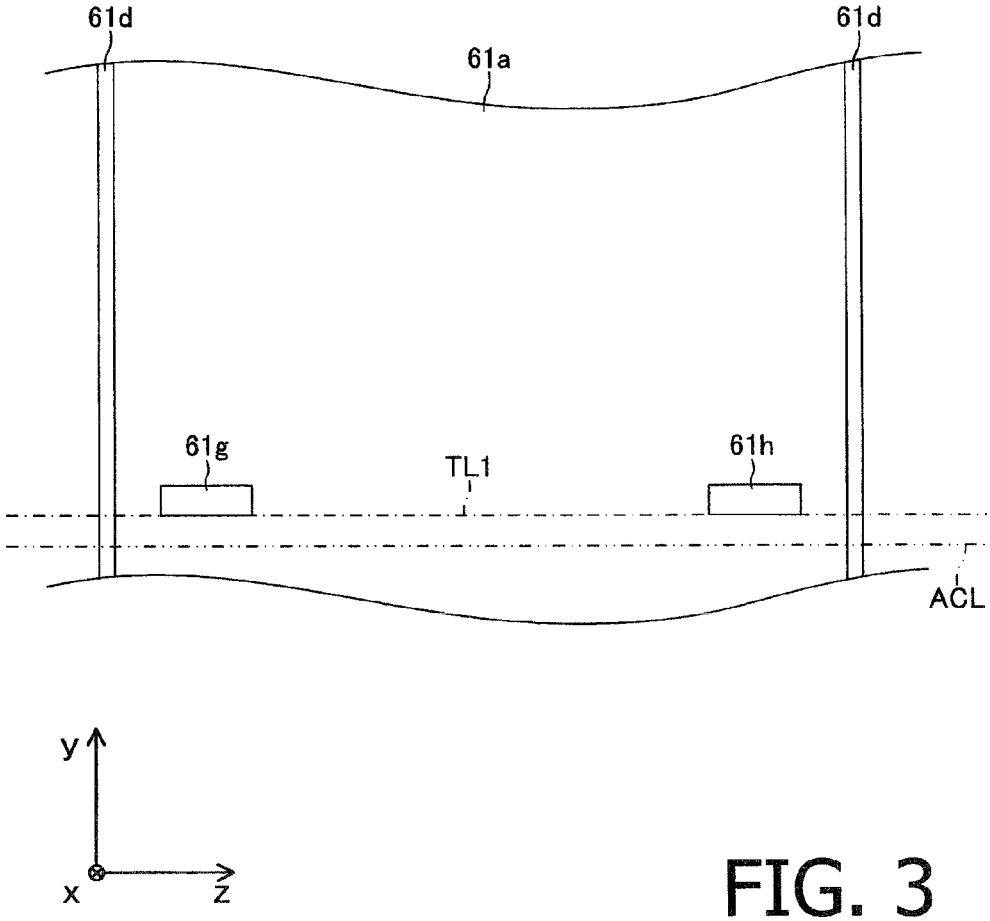
FIG. 3 is a front view showing a rear panel of a casing of the toner supply device when viewed from the inside of the casing in the embodiment according to one or more aspects of the present invention.

FIG. 3 is a front side view of the rear panel 61*a* when viewed from the inside of the casing 61 shown in FIG. 2. Referring to FIGS. 2 and 3, a toner outlet 61*g* and a toner inlet 61*h* are formed at a lower end of the rear panel 61*a*. Each of the toner outlet 61*g* and the toner inlet 61*h* is a through-hole elongated along the z-axis direction (the main scanning direction). The toner outlet 61*g* is provided at an end of the rear panel 61*a* in the z-axis direction. Further, the toner inlet 61*h* is provided at the other end of the rear panel 61*a* in the z-axis direction.

In the embodiment, the toner outlet 61*g* and the toner inlet 61*h* are formed in the same shape, and disposed at the same height in the up-to-down direction. Namely, the toner outlet 61*g* and the toner inlet 61*h* are provided with respective lower ends thereof located at a predetermined height TL1. As will be described below, the predetermined height TL1 is for defining a toner level TL at which the toner T is contained in the toner storage section 61*e*. It is noted that the predetermined height TL1 is set to be higher than a below-mentioned agitator contact level ACL.

Referring back to FIG. 2, by the casing 61, a development roller 62 is supported rotatably around a central axis parallel to the main scanning direction. The development roller 62 is a roller-shaped member having a toner holding surface 62*a* that is a cylindrical circumferential surface parallel to the main scanning direction. The development roller 62 is disposed at an upper end of the casing 61, such that an upper side of the toner holding surface 62*a* is exposed to the outside of the casing 61 via the development-roller exposure opening 61*f*, and that in the development position DP, the upper side of the toner holding surface 62*a* is in proximity to and opposite the electrostatic latent image holding surface LS of the photoconductive drum 3 across a predetermined distance.

In the embodiment, the development roller 62 is driven to rotate in a direction (clockwise in FIG. 2) opposite to the rotational direction of the photoconductive drum 3, such that a moving direction of the toner holding surface 62*a* is substantially the same as the moving direction of the electrostatic latent image holding surface LS in the development position DP. Namely, the development roller 62 is driven to rotate such that the toner holding surface 62*a* moves from a side closer to the front panel 61*b* when viewed from above.

<<<Transfer Board>>>

A transfer board 63 is provided inside the casing 61. The transfer board 63 is fixed onto inner wall surfaces of the front panel 61*b* and the bottom plate 61*c* of the casing 61. The transfer board 63 is formed in a mirror-inverted "J" shape when viewed in the z-axis direction. Further, the transfer board 63 is configured to transfer the toner T along a toner transfer path TTP that is formed in a mirror-inverted "J" shape when viewed in the z-axis direction, under a traveling-wave electric field generated when a transfer bias voltage containing a multi-phase alternating-current (AC) voltage component is applied (it is noted that a tangential direction in a given position on the toner transfer path TTP, in which direction the toner T is transferred, will be referred to as a "toner transfer direction TTD"). In the embodiment, the transfer board 63 includes a bottom transfer board 63*a* and a vertical transfer board 63*b*.

The bottom transfer board 63*a* is formed in an arc shape (substantially in a shape of an upward-open semicircle) when viewed in the z-axis direction. The bottom transfer board 63*a* is supported on the inner wall surface of the bottom plate 61*c* so as to constitute a bottom surface of the toner storage section 61*e*. A downstream end (an upper left end in FIG. 2) of the bottom transfer board 63*a* in the toner transfer direction TTD is smoothly connected with a lower end of the vertical transfer board 63*b*, so as to smoothly transfer the toner T stored in the toner storage section 61*e* to the vertical transfer board 63*b*.

The vertical transfer board 63*b* is a vertically-extending flat plate and supported on the inner wall surface of the front panel 61*b*. The lower end of the vertical transfer board 63*b* faces the toner storage section 61*e*. The upper end of the vertical transfer board 63*b* is disposed in such a position as to be in closest proximity to and opposite the development roller 62 (hereinafter, which position will be referred to as a "toner carrying position TCP"). The vertical transfer board 63*b* is configured to vertically transfer the toner T, which is received from the bottom transfer board 63*a*, up toward the toner carrying position TCP.

Figure 4:
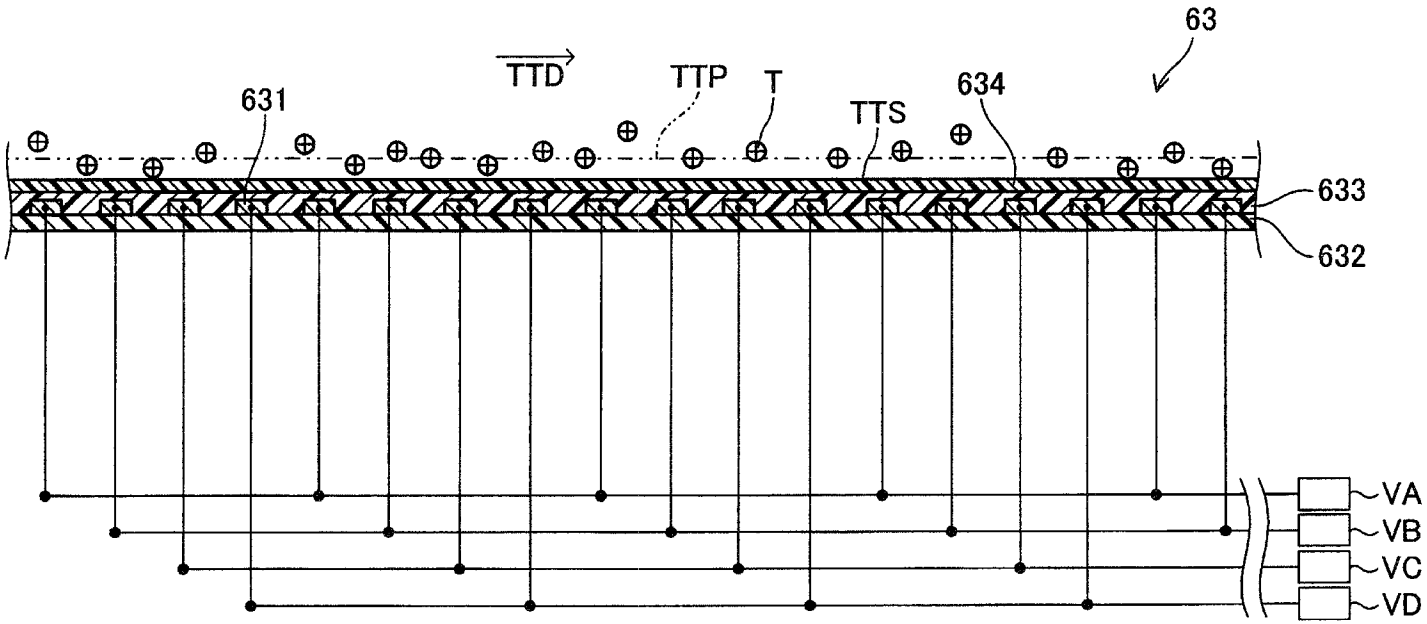
FIG. 4 is an enlarged cross-sectional side view of a transfer board for the toner supply device in the embodiment according to one or more aspects of the present invention.

Referring to FIG. 4, the transfer board 63 is a thin plate member configured in the same manner as a flexible printed-circuit board. Specifically, the transfer board 63 includes transfer electrodes 631, a supporting film layer 632, an electrode coating layer 633, and an overcoating layer 634.

Each transfer electrode 631 is a linear wiring pattern having a longitudinal direction parallel to the main scanning direction. Further, each transfer electrode 631 is formed with a copper thin film having a thickness of tens of micrometers. The transfer electrodes 631 are arranged at intervals of a predetermined distance to be parallel to each other along a toner transfer surface TTS as a surface of the transfer board 63 which surface constitutes the toner transfer path TTP.

The transfer electrodes 631 are formed on a surface of the supporting film layer 632. The supporting film layer 632 is a flexible film made of electrically insulated synthetic resin such as polyimide resin. The electrode coating layer 633 is made of electrically insulated synthetic resin. The electrode coating layer 633 is provided to coat the transfer electrodes 631 and the surface of the supporting film layer 632 on which the transfer electrodes 631 are formed.

On the electrode coating layer 633, the overcoating layer 634 is provided. Namely, the electrode coating layer 633 is formed between the overcoating layer 634 and the transfer electrodes 631. The surface of the overcoating layer 634 (i.e., the toner transfer surface TTS) is formed as a smooth surface with a very low level of irregularity, so as to smoothly convey the toner T.

Every fourth one of the transfer electrodes 631, arranged along the toner transfer path TTP, is connected with a specific one of four power supply circuits VA, VB, VC, and VD. In other words, the transfer electrodes 631 are arranged along the toner transfer path TTP in the following order: a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, . . . .

FIG. 5 exemplifies output waveforms, which are respectively generated by the power supply circuits VA, VB, VC, and VD shown in FIG. 4. In the embodiment, as illustrated in FIG. 5, the power supply circuits VA, VB, VC, and VD are configured to generate respective AC driving voltages having substantially the same waveform. Further, the power supply circuits VA, VB, VC, and VD are configured to generate the respective AC driving voltages with a phase difference of 90 degrees between any adjacent two of the power supply circuits VA, VB, VC, and VD in the aforementioned order. In other words, the power supply circuits VA, VB, VC, and VD are configured to output the respective AC driving voltages each of which is delayed by a phase of 90 degrees behind the voltage output from a precedent adjacent one of the power supply circuits VA, VB, VC, and VD in the aforementioned order.

<<<Configuration for Retrieving Toner>>>

Referring back to FIG. 2, a retrieving roller 64 is housed inside the casing 61, which roller is a roller-shaped member driven to rotate around an axis parallel to the main scanning direction. The retrieving roller 64 is disposed to face the development roller 62 across a predetermined distance, in a toner retrieving position TRP between the development position DP and the toner carrying position TCP (i.e., in a position downstream relative to the development position DP and upstream relative to the toner carrying position TCP) in the moving direction of the toner holding surface 62*a*.

Further, the retrieving roller 64 is configured to, when a predetermined retrieving voltage is applied between the retrieving roller 64 and the development roller 62, retrieve the toner T from toner holding surface 62*a*. In the embodiment, the retrieving roller 64 is driven to rotate in a direction opposite to the rotational direction of the development roller 62, so as to make a moving direction of a circumferential surface thereof in the toner retrieving position TRP identical to the moving direction of the toner holding surface 62*a*.

Beneath the retrieving roller 64, a removal blade 65 is disposed to contact (slide in contact with) the circumferential surface of the retrieving roller 64, in a position opposite the toner retrieving position TRP with respect to the rotational center axis of the retrieving roller 64 (i.e., in a downstream position relative to the toner retrieving position TRP in the moving direction of the circumferential surface of the retrieving roller 64). The removal blade 65 is provided inside the casing 61 to remove, from the circumferential surface of the retrieving roller 64, the toner T retrieved from the toner holding surface 62*a* by the retrieving roller 64.

<<<Configuration for Agitating Toner>>>

An agitator 66 is disposed at a bottom in the internal space of the casing 61. The agitator 66 includes an agitator shaft 66*a* and a rotational blade 66*b*. The agitator shaft 66*a* is a rotational center axis of the agitator 66 that is formed in shape of a round bar. The agitator shaft 66*a* is disposed parallel to the main scanning direction and rotatably supported by the side panels 61*d*. The rotational blade 66*b* is fixed to the agitator shaft 66*a*.

The agitator 66 is provided such that a distal end of the rotational blade 66*b* slides in contact with the surface of the bottom transfer board 63*a*. Specifically, the agitator 66 is configured such that a radius of a trajectory drawn by the distal end of the rotational blade 66*b* rotating is identical to a curvature radius of the toner transfer surface TTS of the bottom transfer board 63*a* when viewed in the z-axis direction. Thus, the agitator 66 is configured such that an agitator contact level ACL, which is an upper end of an area within which the distal end of the rotational blade 66*b* contacts the toner transfer surface TTS, is as high as a downstream end of the bottom transfer board 63*a* in the toner transfer direction TTD and lower than the predetermined height TL1. Further, the agitator 66 is driven to rotate in such a direction (clockwise in FIG. 2) that a direction in which the distal end of the rotational blade 66*b* moves in contact with the toner transfer surface TTS is identical to the toner transfer direction TTD of the bottom transfer board 63*a*. Thereby, it is possible to agitate (fluidize) the toner T stored in the toner storage section 61*e*.

<<<Configuration for Adjusting Toner Level>>>

The toner supply device 6 includes a toner level adjusting unit 67. The toner level adjusting unit 67 is configured to adjust a toner level TL, which is a height level of the toner T stored in the toner storage section 61*e* while agitated by the agitator 66, to be close to the predetermined level TL1 higher than the agitator contact level ACL.

Specifically, in the embodiment, the toner level adjusting unit 67 includes a toner storage tank 67*a*, a sub storage section 67*b* connected with the toner storage tank 67*a* via the toner outlet 67*a*1, a delivery auger 67*c* housed in a bottom portion of the toner storage tank 67*a*, and a circulation auger 67*d* housed in the sub storage section 67*b*.

The toner storage tank 67*a* is a box-shaped member disposed near the rear panel 61*a*. In the toner storage tank 67*a*, unused toner T is stored. The delivery auger 67*c* is driven as needed (depending on the amount of the toner T in the toner storage section 61*e*) to rotate and deliver the toner T from the bottom portion of the toner storage tank 67*a* to the sub storage section 67*b*. The sub storage section 67*b* is a box-shaped member formed substantially in a cylindrical shape with an axis line parallel to the main scanning direction. The sub storage section 67*b* is disposed between the toner storage section 61*e* and the toner storage tank 67*a*. Namely, the sub storage section 67*b* is disposed to be adjacent to the toner storage section 61*e* along the horizontal direction (i.e., the front-to-rear direction or the x-axis direction in FIG. 2).

The sub storage section 67*b* is formed with a toner admission port 67*g* and a toner supply port 67*h*. The toner admission port 67*g* is disposed in a position facing the toner outlet 61*g*, so as to communicate with the toner outlet 61*g*. The toner supply port 67*h* is disposed in a position facing the toner inlet 61*h*, so as to communicate with the toner inlet 61*h*. The sub storage section 67*b* is connected with the toner storage section 61*e* via the toner admission port 67*g* and the toner supply port 67*h*.

The circulation auger 67*d* is always driven to rotate when the agitator 66 is rotated. Thereby, the circulation auger 67*d* is configured to, while agitating the toner T stored in the sub storage section 67*b*, deliver the toner T in the z-axis direction and circulate the toner T between the sub storage section 67*b* and the toner storage section 61*e*. Namely, when driven to rotate, the circulation auger 67*d* supplies the toner T from the sub storage section 67*b* to the toner storage section 61*e* via the toner supply port 67*h* and the toner inlet 61*h*, and discharges the toner T from the toner storage section 61*e* to the sub storage section 67*b* via the toner outlet 61*g* and toner admission port 67*g*.

<General Overview of Operations of Laser Printer>

Subsequently, a general overview will be provided of operations of the laser printer 1 configured as above with reference to the relevant drawings.

<<Sheet Feeding Operation>>

Referring to FIG. 1, firstly, a leading end of a sheet P placed on the feed tray (not shown) is fed to the registration rollers 21. The registration rollers 21 perform skew correction for the sheet P, and adjust a moment when the sheet P is to be fed forward. After that, the sheet P is fed to the transfer position TP.

<<Formation of Toner Image on Electrostatic Latent Image Holding Surface>>

While the sheet P is being conveyed to the transfer position TP as described above, an image of the toner T (hereinafter referred to as a toner image) is formed on the electrostatic latent image holding surface LS that is the outer circumferential surface of the photoconductive drum 3, as will be mentioned below.

<<Formation of Electrostatic Latent Image>>

Firstly, the electrostatic latent image holding surface LS of the photoconductive drum 3 is charged evenly and positively by the electrification device 4. The electrostatic latent image holding surface LS, charged by the electrification device 4, is moved along the auxiliary scanning direction to the scanned position SP to face the scanning unit 5, when the photoconductive drum 3 rotates in the direction indicated by arrows in FIG. 1.

In the scanned position SP, the electrostatic latent image holding surface LS is exposed to the laser beam LB modulated based on the image data. Namely, while being scanned along the main scanning direction, the laser beam LB is rendered incident onto the electrostatic latent image holding surface LS. In accordance with the modulation of the laser beam LB, areas with no positive charge remaining thereon are generated on the electrostatic latent image holding surface LS. Thereby, an electrostatic latent image is formed with a positive charge pattern (positive charges distributed in the shape of an image) on the electrostatic latent image holding surface LS. The electrostatic latent image, formed on the electrostatic latent image holding surface LS, is transferred to the development position DP to face the toner supply device 6 when the photoconductive drum 3 rotates in the direction indicated by the arrows in FIG. 1.

<<Transfer and Supply of Charged Toner>>

Referring to FIGS. 2 and 4, the toner T stored in the casing 61 is charged due to contact and/or friction with the overcoating layer 634 on the bottom transfer board 63*a*. The charged toner T, which is in contact with or proximity to the overcoating layer 634 on the bottom transfer board 63*a*, is conveyed in the toner transfer direction TTD, by the traveling-wave electric field generated when the aforementioned transfer bias voltage containing the multi-phase AC voltage component (e.g., a transfer bias voltage of +500 V to +1100 V containing a DC voltage component of +800 V and a multi-phase AC voltage component with an amplitude of 300 V and a frequency of 300 Hz) is applied to the transfer electrodes 631 of the bottom transfer board 63*a*. Thereby, the charged toner T is smoothly transferred to the vertical transfer board 63*b*.

The vertical transfer board 63*b* conveys the toner T, received at the lower end of the vertical transfer board 63*b* from the bottom transfer board 63*a*, vertically up toward toner carrying position TCP, by the traveling-wave electric field generated when the aforementioned transfer bias voltage is applied to the transfer electrodes 631 of the vertical transfer board 63*b*. In the vicinity of the toner carrying position TCP, the toner T, conveyed to the toner carrying position TCP by the vertical transfer board 63*b*, is held and carried on the toner holding surface 62*a* as the circumferential surface of the development roller 62, to which a development bias (e.g., a voltage of −800 V to 1800 V containing a DC voltage component of +500 V and an AC voltage component with an amplitude of 1300 V and a frequency of 200 kHz) is applied.

Here, the toner T transferred from the bottom transfer board 63*a* to the vertical transfer board 63*b* contains toner charged in an undesired manner as well (e.g., negatively charged toner, inadequately charged toner, and uncharged toner). Nonetheless, in the embodiment, inappropriately charged toner leaves the toner transfer path TTP and drops from the vertical transfer board 63*b* by the action of the gravity and/or the aforementioned electric fields, when being conveyed vertically up toward the toner carrying position TCP by the vertical transfer board 63*b*, or being held and carried on the development roller 62 in the vicinity of the toner carrying position TCP by the electric field generated between the vertical transfer board 63*b* and the development roller 62.

Thereby, it is possible to selectively convey adequately charged toner T to the toner carrying position TCP. Namely, it is possible to discriminate the adequately charged toner T from the inappropriately charged toner T by the vertical transfer board 63*b*, in a favorable manner. The toner T, which has left the toner transfer path TTP and dropped, returns into the toner storage section 61*e*.

Then, when the development roller 62 is driven to rotate and the toner holding surface 62*a* moves to the development position DP, the toner T is supplied to the vicinity of the development position DP. In the vicinity of the development position DP, the electrostatic latent image formed on the electrostatic latent image holding surface LS is developed with the toner T. Namely, the toner T is transferred from the toner holding surface 62*a*, and adheres to the areas with no positive charge on the electrostatic latent image holding surface LS. Thereby, the toner image is formed and held on the electrostatic latent image holding surface LS.

The toner T, which has passed through the development position DP and still remains on the toner holding surface 62*a* (without being consumed in the development position DP), reaches the vicinity of the toner retrieving position TRP in response to the development roller 62 rotating. In the vicinity of the toner retrieving position TRP, the toner T transfers (jumps) onto the retrieving roller 64, to which the retrieving bias (a voltage of −1300 V to 1300 V containing a DC voltage component of 0 V and an AC voltage component with an amplitude of 1300 V and a frequency of 2 kHz). Namely, the toner T, which has passed through the development position DP and still remains on the toner holding surface 62*a*, is retrieved by the retrieving roller 64.

The retrieving roller 64 rotates while retrieving the toner T from the toner holding surface 62*a*. Then, the toner T adhering to the retrieving roller 64 is removed by the removal blade 65 in a position opposite to the toner retrieving position TRP across the retrieving roller 64, and drops into the toner storage section 61*e*. Therefore, areas on the retrieving roller 64, where the toner T adhering onto the retrieving roller 66 is removed or reduced, sequentially come to the toner retrieving position TRP.

<<Transfer of Toner Image from Electrostatic Latent Image Holding Surface onto Sheet>>

Referring to FIG. 1, the toner image, which is held on the electrostatic latent image holding surface LS of the photoconductive drum 3 as described above, is conveyed to the transfer position TP when the electrostatic latent image holding surface LS turns in the direction indicated by the arrows in FIG. 1. Then, in the transfer position TP, the toner image is transferred from the electrostatic latent image holding surface LS onto the sheet P.

<Operations and Effects>

Subsequently, an explanation will be provided about operations and effects that the toner supply device 6 of the embodiment provides, with reference to the relevant drawings.

While the toner T is being transferred by the transfer board 63, the agitator 66 and the circulation auger 67*d* are driven to rotate. Hence, the toner T stored in the toner storage section 61*e* and the sub storage section 67*b* is agitated (fluidized) in a favorable manner. The delivery auger 67*c* is driven to rotate as needed (e.g., when a toner level sensor (not shown) detects that the toner level TL is lower than the predetermined level TL1). Thereby, the toner T is circulated between the toner storage section 61*e* and the sub storage section 67*b*, and the toner level TL which is a height level of the toner T stored in the toner storage section 61*e* is adjusted (maintained) to be around the predetermined level TL1 which corresponds to the lower ends of the toner outlet 61*g* and the toner inlet 61*h*, in the following way.

The circulation auger 67*d* delivers the toner T contained in the sub storage section 67*b* in the z-axis direction, namely, in the direction from the toner admission port 67*g* toward the toner supply port 67*h* (i.e., the direction from the outlet 61*g* toward the toner inlet 61*h*). Therefore, the toner T contained in the sub storage section 67*b* is introduced into the toner storage section 61*e* via the toner supply port 67*h* and the toner inlet 61*h*. Meanwhile, the toner T contained in the toner storage section 61*e* is discharged into the sub storage section 67*b* via the toner outlet 61*g* and the toner admission port 67*g*.

The rotational blade 66*b* of the agitator 66 slides in contact with the toner transfer surface TTS under the toner level TL, and moves in the same direction as the toner transfer direction TTD on the toner transfer surface TTS.

FIG. 6A shows an experimental result of a comparison between a time-dependent change of the amount of the toner T transferred by the transfer board 63 when the toner level TL is higher than the agitator contact level ACL (high toner level) and that when the level TL is lower than the agitator contact level ACL (low toner level). Here, the "transfer amount" for the vertical axis represents a mass per unit area [mg/cm$^2$] of the toner T transferred on the toner holding surface 62*a*. Further, the "number of transfers" for the horizontal axis denotes a number of times expressed with the value "1" as a single rotation of the development roller 62.

As shown in FIG. 6A, when the toner level TL is lower than the agitator contact level ACL (low toner level), the transfer amount of the toner T drastically drops. In contrast, when the toner level TL is higher than the agitator contact level ACL (high toner level), the transfer amount of the toner T is stable (insensitive to the number of transfers).

FIG. 6B shows an experimental result of a comparison between a time-dependent change of the amount of the toner T transferred by the transfer board 63 when the toner level TL is higher than the agitator contact level ACL and the agitator 66 is normally rotated in the aforementioned direction (clockwise in FIG. 2) (high toner level and normally-rotating agitator: the same condition as "high toner level" in FIG. 6A) and that when the level TL is lower than the agitator contact level ACL and the agitator 66 is reversely rotated (counterclockwise in FIG. 2) (low toner level and reversely-rotating agitator).

As is clear from the comparison between "low toner level" in FIG. 6A and "low toner level and reversely-rotating agitator" in FIG. 6B, when the agitator 66 is reversely rotated, an initial value of the transfer amount of the toner T is small and the transfer amount drops more drastically.

FIG. 6C shows an experimental result of a comparison between a time-dependent change of the amount of the toner T transferred by the transfer board 63 under the condition that the toner level TL is higher than the agitator contact level ACL and the agitator 66 is normally rotated (clockwise in FIG. 2) when the agitator 66 (the rotational blade 66*b*) is rendered in contact with the toner transfer surface TTS (agitator in contact) and that when the agitator 66 is separated from the toner transfer surface TTS (agitator in non-contact).

As shown in FIG. 6C, when the agitator 66 (the rotational blade 66*b*) is rendered in contact with the toner transfer surface TTS (agitator in contact), the transfer amount of the toner T is stable (insensitive to the number of transfers). On the contrary, when the agitator 66 is separated from the toner transfer surface TTS (agitator in non-contact), the transfer amount of the toner T decreases in a manner more sensitive to the number of transfers than the above case "agitator in contact."

As is clear from the aforementioned experimental results, in the embodiment, the amount of the toner T transferred by the transfer board 63 from the toner storage section 61*e* to the toner carrying position TCP is rendered stable when (1) the toner level TL in the toner storage section 61*e* is adjusted to be higher than the agitator contact level ACL, and (2) the rotational blade 66*b* of the agitator 66 slides in contact with the toner transfer surface TTS below the toner level TL and moves in the same direction as the toner transfer direction TTD. The above result is considered to be caused for the following reasons.

In a toner supply device of this kind that transfers the toner T under an electric field generated on the transfer board 63, a contact portion between the toner level TL and the toner transfer surface TTS is a substantial starting point (hereinafter referred to as an "activating point") from which the toner T begins to be transferred under the electric field. A contact state between the toner transfer surface TTS and the toner T at the activating point exerts an influence on transfer conditions (the transfer amount and the uniformity thereof) under which the toner T is transferred on the transfer board 63 (the vertical transfer board 63*b*).

For instance, when the toner T is not sufficiently agitated (fluidized) in the toner storage section 61*e*, the toner level TL might cave in locally and drastically as a "cliff" at the activating point (see a reference character "G" in FIG. 7, in which the agitator 66 shown in FIG. 2 is not shown). When such a "cliff G" is formed, the transfer amount of the toner T decreases and the uniformity of the transfer amount in each of the main scanning direction and the toner transfer direction TTD is deteriorated. Therefore, the toner T contained in the toner storage section 61*e* needs to be sufficiently agitated (fluidized) so as to establish a favorable contact state between the toner transfer surface TTS and the toner T (the toner level TL) at the activating point.

Meanwhile, when the toner T adheres to an area on the toner transfer surface TTS, the transfer amount of the toner T in the area is reduced and the uniformity of the transfer amount of the toner T in the main scanning direction is deteriorated. Thus, adhesion of the toner T onto the toner transfer surface TTS needs to be dissolved (prevented) in a favorable manner.

In this regard, in the embodiment, since the rotational blade 66*b* of the agitator 66 slides in contact with the toner transfer surface TTS under the toner level TL and moves in the same direction as the toner transfer direction TTD, it is possible to dissolve (prevent) adhesion of the toner T onto the toner transfer surface TTS and establish a favorable contact state between the toner transfer surface TTS and the toner T at the activating point.

As described above, according to the toner supply device 6 of the embodiment, the amount of the toner T carried on the toner holding surface 62*a* is rendered stable, and thereby it is possible to supply a stable amount of toner T onto the photoconductive drum 3.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

Aspects of the present invention may be applied to electrophotographic image forming apparatuses such as color laser printers, and monochrome and color copy machines, as well as the single-color laser printer as exemplified in the aforementioned embodiment. Further, the photoconductive body is not limited to the drum-shaped one as exemplified in the aforementioned embodiment. For instance, the photoconductive body may be formed in shape of a plate or an endless belt.

Additionally, light sources (e.g., LEDs, electroluminescence devices, and fluorescent substances) other than a laser scanner may be employed as light sources for exposure. In such cases, the "main scanning direction" may be parallel to a direction in which light emitting elements such as LEDs are aligned. Namely, the "main scanning direction" may be referred to as a "sheet width direction" (a direction always perpendicular to a sheet feeding direction) or a "device width direction."

Alternatively, aspects of the present invention may be applied to image forming apparatuses employing methods other than the aforementioned electrophotographic method (e.g., a toner-jet method using no photoconductive body, an ion flow method, and a multi-stylus electrode method).

The number of the toner outlet 61*g* or the toner inlet 61*h* or a positional relationship therebetween is not limited to that as exemplified in the aforementioned embodiment. For example, the toner outlet 61*g* or the toner inlet 61*h* may be disposed substantially in a center in the main scanning direction. Further, the toner inlet 61*h* may be disposed in a position higher than the toner outlet 61*g*.

The development roller 62 may be disposed such that the toner holding surface 62*a* contacts the electrostatic latent image holding surface LS in the development position DP. Further, the development roller 62 may be substitutable for a sleeve-shaped one.

The configuration of the transfer board 63 is not limited to that as exemplified in the aforementioned embodiment. For example, the overcoating layer 634 may not necessarily be provided. Alternatively, the transfer electrodes 631 may be implanted in the supporting film layer 632. In this case, the transfer board 63 may be configured without the electrode coating layer 633 or the overcoating layer 634.

The vertical transfer board 63*b* may be slightly tilted as far as it extends substantially along the up-to-down direction.

Instead of or together with the retrieving roller 64, a retrieving board configured in the same manner as the transfer board 63 may be employed. In this case, the toner supply device 6 may be configured without the removal blade 65.

The configuration of the agitator 66 is not limited to that as exemplified in the aforementioned embodiment. For example, the number or the shape of the rotational blade(s) 66*b* is not limited. Specifically, instead of the rotational blade 66*b*, an agitating member formed in shape of a stick parallel to the main scanning direction may be employed. Further, the agitator 66 may be configured (disposed) such that the agitator contact level ACL is lower than a downstream end of the bottom transfer board 63*a* in the toner transfer direction TTD.

The configuration or the operation of the toner level adjusting unit 67 is not limited to that as exemplified in the aforementioned embodiment. For example, the delivery auger 67*c* may be driven depending on the number of sheets and/or a time required for image formation.

Hereinafter, referring to FIGS. 8-11, a detailed explanation will be provided about a configuration of a laser printer 1 including a toner supply device 6 in a modification according to aspects of the present invention. In the modification, the toner supply device 6 is configured and disposed to supply toner T to a photoconductive drum 3 laterally (in the front-to-rear direction or the x-axis direction).

A casing 61 is formed with a rear panel 61*a*, a bottom plate 61*c*, and a top plate 61*k*, so as to have a laterally-facing U-shaped cross-sectional side view, as shown in FIG. 10. A toner storage section 61*e* is disposed at a bottom of a far-side end (an end farther from the photoconductive drum 3) opposite a development-roller exposure opening 61*f* in the x-axis direction inside the casing 61. Namely, the toner storage section 61*e* is disposed at a bottom of a substantially laterally-open C-shaped portion at a far side (opposite the development-roller exposure opening 61*f*) inside the casing 61.

The rear panel 61*a* is a substantially arc-shaped portion that is disposed at a far side (opposite the development-roller exposure opening 61*f*) in the x-axis direction inside the casing 61 and open laterally toward the development-roller exposure opening 61*f*. The top plate 61*k* is a substantially flat plate that substantially horizontally extends from an upper end of the rear panel 61*a* toward the photoconductive drum 3.

A transfer board 63 is disposed to extend along (over a range of) a far-side end of the bottom plate 61*c* adjacent to the rear panel 61*a*, the rear panel 61*a*, and the top plate 61*k*. Specifically, a bottom transfer board 63*a* is a substantially flat plate disposed to extend obliquely up toward a far side in the x-axis direction, over a range from the far-side end of the bottom plate 61*c* adjacent to the bottom plate 61*c* to a lower end of the rear panel 61*a*. A down-facing transfer board 63*c* is a flat plate disposed to be substantially parallel to the horizontal plane, and supported on an inner wall surface of the top plate 61*k* so as to have a toner transfer surface TTS facing downward. An upper end (a downstream end in the toner transfer direction TTD) of the bottom transfer board 63*a* is connected with a far-side end (an upstream end in the toner transfer direction TTD) of the down-facing transfer board 63*c* via a substantially C-shaped joint portion 63*d*.

The bottom plate 61*c* includes a first partition rib 61*m* and a second partition rib 61*n* that are configured to protrude upward. The first partition rib 61*m* is disposed in a position farther from the development-roller exposure opening 61*f* than the second partition rib 61*n* in the x-axis direction. Further, the second partition rib 61*n* is configured to be higher than the first partition rib 61*m*.

The toner storage section 61*e* is disposed to be adjacent to the first partition rib 61*m* and farther from the development-roller exposure opening 61*f* than the first partition rib 61*m* in the x-axis direction. A portion of a bottom inside the casing 61, which portion is closer to the development-roller exposure opening 61*f* than the toner storage section 61*e*, is sectioned by the second partition rib 61*n* into a first sub storage section 61*r*1 and a second sub storage section 61*r*2. In addition, the first partition rib 61*m* separates the toner storage section 61*e* from the first sub storage section 61*r*1.

Each of the first sub storage section 61*r*1 and the second sub storage section 61*r*2 is formed substantially in an upward-open "C" or "U" shape when viewed in the z-axis direction, and extends along the main scanning direction. The first sub storage section 61*r*1 is disposed in a position adjacent to the toner storage section 61*e*. The second sub storage section 61*r*2 is disposed in proximity to the development roller 62 so as to receive the toner T retrieved from the toner holding surface 62*a* by a retrieving unit (which is not shown in FIG. 10 for the sake of a simple illustration but may include the retrieving roller 64 and the removal blade 65 as shown in FIG. 2).

An agitator 66 includes an agitating element 66*c* as a round bar parallel to the main scanning direction (i.e., the z-axis direction). The agitator 66 is provided such that the agitating element 66*c* thereof slides in contact with a lower end of the bottom transfer board 63*a*. The agitator 66 is driven to rotate in such a direction (counterclockwise in FIG. 10) that the agitating element 66*c* slides in contact with the lower end of the bottom transfer board 63*a* in the same direction as the toner transfer direction TTD.

A subsidiary toner container 67*k* is disposed at an end adjacent to the casing 61 in the main scanning direction (i.e., the z-axis direction). The subsidiary toner container 67*k* is a box-shaped member disposed in a position facing the first sub storage section 61*r*1 and the second sub storage section 61*r*2 in the main scanning direction. The subsidiary toner container 67*k* is formed integrally with the casing 61, so as to communicate with the casing 61. Namely, each of the first sub storage section 61*r*1 and the second sub storage section 61*r*2 is configured to extend across the casing 61 and the subsidiary toner container 67*k*. Further, near-side ends (on a near side with respective to a sheet plane of FIG. 10) of the first sub storage section 61*r*1 and the second sub storage section 61*r*2 in the main scanning direction (i.e., the z-axis direction) form a first communication section via which the first sub storage section 61*r*1 and the second sub storage section 61*r*2 communicate with each other. Furthermore, far-side ends (on a far side with respect to the sheet plane of FIG. 10) of the first sub storage section 61*r*1 and the second sub storage section 61*r*2 in the main scanning direction (i.e., the z-axis direction) form a second communication section as well via which the first sub storage section 61*r*1 and the second sub storage section 61*r*2 communicate with each other.

A delivery auger 67*c* is configured to convey the toner T contained in the second sub storage section 61*r*2 in the z-axis direction while agitating (fluidizing) the toner T. A circulation auger 67*d* is configured to convey the toner T contained in the first sub storage section 61*r*1 in the z-axis direction while agitating (fluidizing) the toner T. In the modification, the delivery auger 67*c* and the circulation auger 67*d* are always driven to rotate when the agitator 66 is driven to rotate. Further, the delivery auger 67*c* is driven to rotate such that the toner T is transferred thereby at a higher transfer velocity than by the circulation auger 67*d* (specifically, to rotate at a higher revolution speed than the circulation auger 67*d*).

A toner storage tank 67*a* is disposed above the subsidiary toner container 67*k*. The toner storage tank 67*a* is connected with the subsidiary toner container 67*k* via a toner supply tube 67*m*. The toner supply tube 67*m* is configured to make unused toner T stored in the toner storage tank 67*a* fall into the second sub storage section 61*r*2. The toner supply tube 67*m* has a toner supply controller 67*n* that is attached in the middle of a vertical length thereof and configured to control the amount of the toner T to be supplied from the toner storage tank 67*a* to the subsidiary toner container 67*k*. The toner supply controller 67*n* is driven depending on the amounts of the toner T contained in the casing 61 and the subsidiary toner container 67*k*.

According to the toner supply device 6 configured as above in the modification, the toner T is sorted in a more favorable manner by the down-facing transfer board 63*c* with the toner transfer surface TTS facing downward, selectively depending on a charged state of the toner T. Further, by the operations of the agitator 66, the delivery auger 67*c*, and the circulation auger 67*d*, a toner level TL of the toner T contained in the toner storage section 61*e* is adjusted as high as the second partition rib 61*n* higher than an agitator contact level ACL (see FIG. 10).

Specifically, by the operations of the agitator 66, the delivery auger 67*c*, and the circulation auger 67*d*, the toner T contained in the toner storage section 61*e*, the first sub storage section 61*r*1, and the second sub storage section 61*r*2 is agitated (fluidized) in a favorable manner. Further, by the delivery auger 67*c* of a higher transfer velocity, the toner T stored in the second sub storage section 61*r*2 is transferred toward the near-side end of the second sub storage section 61*r*2 in the main scanning direction (i.e., the z-axis direction), and delivered to the first sub storage section 61*r*1 through the first communication section (in the z-axis direction) via which the first sub storage section 61*r*1 and the second sub storage section 61*r*2 communicate with each other. The toner T, which spills out of the first sub storage section 61*r*1, transfers into the toner storage section 61*e* over the first partition rib 61*m* or returns into the second sub storage section 61*r*2 through the second communication section (in the z-axis direction) via which the first sub storage section 61*r*1 and the second sub storage section 61*r*2 communicate with each other. Further, the toner T, which spills out of the toner storage section 61*e*, transfers into the first sub storage section 61*r*1 over the first partition rib 61*m*.

As described above, in the modification as well, the toner level TL in the toner storage section 61*e* is adjusted to be higher than the agitator contact level ACL. Further, the agitating element 66*c* of the agitator 66 slides in contact with the toner transfer surface TTS below the toner level TL and moves in the same direction as the toner transfer direction TTD. Thereby, it is possible to render stable the amount of the toner T transferred by the transfer board 63.

What is claimed is:

1. A developer supply device configured to supply charged development agent to an intended device, comprising:

a casing comprising a developer storage section configured to accommodate the development agent to be supplied;

a transfer board comprising a plurality of transfer electrodes, the transfer board being configured to transfer the development agent from the developer storage section to the intended device in a predetermined developer transfer direction under a traveling-wave electric field generated when a transfer bias containing a multi-phase alternating-current voltage component is applied to the transfer electrodes, the transfer board being fixed onto an inner wall of the casing from the developer storage section to a downstream side in the developer transfer direction;

a developer fluidizing unit comprising a movable member configured to move in a moving direction identical to the developer transfer direction while contacting a predetermined contact range of a developer transfer surface of the transfer board disposed along an inner wall of the developer storage section, the developer fluidizing unit being configured to fluidize the development agent stored in the developer storage section by movement of the movable member; and a developer level adjusting unit configured to adjust a level of the development agent stored in the developer storage section to be higher than a downstream end of the predetermined contact range of the developer transfer surface of the transfer board in the moving direction of the movable member, wherein the developer level adjusting unit comprises:

a sub storage section that is configured to accommodate the development agent and disposed in a position horizontally adjacent to the developer storage section;

a sub agitating member configured to agitate the development agent stored in the sub storage section; and a communication path through which the developer storage section horizontally communicates with the sub storage section and the development agent is transferred between the developer storage section and the sub storage section, wherein the communication path comprises:

a developer introduction path configured to introduce the development agent from the sub storage section to the developer storage section; and a developer discharge path configured to discharge the development agent from the developer storage section to the sub storage section, and the developer discharge path being disposed in a different position from the developer introduction path in a width direction perpendicular to the developer transfer direction, the developer discharge path having a discharge opening on a side closer to the developer storage section than to the sub storage section, the discharge opening being open in a position higher than downstream end of the predetermined contact range of the developer transfer surface of the transfer board in the moving direction of the movable member.

2. The developer supply device according to claim 1, wherein the developer introduction path has an introduction opening on a side closer to the developer storage section than to the sub storage section, the introduction opening being disposed as high as the discharge opening of the developer discharge path on the side closer to the developer storage section than to the sub storage section.

3. The developer supply device according to claim 1, wherein the casing is substantially a U-shaped casing that comprises an upward-open half-cylindrical portion forming the developer storage section, and wherein the transfer board comprises:

an arc-shaped section that is disposed on and along the upward-open half-cylindrical portion and formed in a shape of an arc when viewed in a width direction perpendicular to the developer transfer direction; and a flat plate section that extends, from the arc-shaped section, up toward the intended device.

4. The developer supply device according to claim 1, wherein the casing is substantially a laterally-facing U-shaped casing that comprises a substantially laterally-open C-shaped portion forming the developer storage section, and wherein the transfer board comprises:

an arc-shaped section that is disposed on and along the substantially laterally-open C-shaped portion and formed in a shape of an arc when viewed in a width direction perpendicular to the developer transfer direction; and a flat plate section that extends, from the arc-shaped section, laterally toward the intended device, the flat plate section having a down-facing developer transfer surface on which the development agent is transferred.

5. The developer supply device according to claim 1, wherein the developer fluidizing unit comprises:

an agitator shaft formed as a rotational center axis parallel to a width direction perpendicular to the developer transfer direction; and a rotational blade formed around the agitator shaft as the movable member.

6. An image forming apparatus comprising:

a photoconductive body configured such that a development agent image is formed thereon; and a developer supply device configured to supply charged development agent to the photoconductive body, wherein the developer supply device comprises:

a casing comprising a developer storage section configured to accommodate the development agent to be supplied;

a transfer board comprising a plurality of transfer electrodes, the transfer board being configured to transfer the development agent from the developer storage section to the photoconductive body in a predetermined developer transfer direction under a traveling-wave electric field generated when a transfer bias containing a multi-phase alternating-current voltage component is applied to the transfer electrodes, the transfer board being fixed onto an inner wall of the casing from the developer storage section to a downstream side in the developer transfer direction;

a developer fluidizing unit comprising a movable member configured to move in a moving direction identical to the developer transfer direction while contacting a predetermined contact range of a developer transfer surface of the transfer board disposed along an inner wall of the developer storage section, the developer fluidizing unit being configured to fluidize the development agent stored in the developer storage section by movement of the movable member; and a developer level adjusting unit configured to adjust a level of the development agent stored in the developer storage section to be higher than a downstream end of the predetermined contact range of the developer transfer surface of the transfer board in the moving direction of the movable member, wherein the developer level adjusting unit comprises:

a sub storage section that is configured to accommodate the development agent and disposed in a position horizontally adjacent to the developer storage section;

a sub agitating member configured to agitate the development agent stored in the sub storage section; and a communication path through which the developer storage section horizontally communicates with the sub storage section and the development agent is transferred between the developer storage section and the sub storage section, and wherein the communication path comprises:

a developer introduction path configured to introduce the development agent from the sub storage section to the developer storage section; and a developer discharge path configured to discharge the development agent from the developer storage section to the sub storage section, the developer discharge path being disposed in a different position from the developer introduction path in a width direction perpendicular to the developer transfer direction, the developer discharge path having a discharge opening on a side closer to the developer storage section than to the sub storage section, the discharge opening being open in a position higher than downstream end of the predetermined contact range of the developer transfer surface of the transfer board in the moving direction of the movable member.

7. The image forming apparatus according to claim 6, wherein the developer introduction path has an introduction opening on a side closer to the developer storage section than to the sub storage section, the introduction opening being disposed as high as the discharge opening of the developer discharge path on the side closer to the developer storage section than to the sub storage section.

8. The image forming apparatus according to claim 6, wherein the casing is substantially a U-shaped casing that comprises an upward-open half-cylindrical portion forming the developer storage section, and wherein the transfer board comprises:

an arc-shaped section that is disposed on and along the upward-open half-cylindrical portion and formed in a shape of an arc when viewed in a width direction perpendicular to the developer transfer direction; and a flat plate section that extends, from the arc-shaped section, up toward the photoconductive body.

9. The image forming apparatus according to claim 6, wherein the casing is substantially a laterally-facing U-shaped casing that comprises a substantially laterally-open C-shaped portion forming the developer storage section, and wherein the transfer board comprises:

an arc-shaped section that is disposed on and along the substantially laterally-open C-shaped portion and formed in a shape of an arc when viewed in a width direction perpendicular to the developer transfer direction; and a flat plate section that extends, from the arc-shaped section, laterally toward the photoconductive body, the flat plate section having a down-facing developer transfer surface on which the development agent is transferred.

10. The image forming apparatus according to claim 6, wherein the developer fluidizing unit comprises:

an agitator shaft formed as a rotational center axis parallel to a width direction perpendicular to the developer transfer direction; and a rotational blade formed around the agitator shaft as the movable member.

* * * * *